US008816843B2

(12) United States Patent
Cooper et al.

(10) Patent No.: US 8,816,843 B2
(45) Date of Patent: Aug. 26, 2014

(54) SMOKE OR FIRE BARRIER

(75) Inventors: Andrew Paul Cooper, Rowlands Castle (GB); Victoria Louise Ford, Portsmouth (GB); Philip Shaw, Portsmouth (GB)

(73) Assignee: Coopers Fire Ltd., Hampshire (GB)

( * ) Notice: Subject to any disclaimer, the term of this patent is extended or adjusted under 35 U.S.C. 154(b) by 166 days.

(21) Appl. No.: 13/405,841

(22) Filed: Feb. 27, 2012

(65) Prior Publication Data

US 2013/0222130 A1 Aug. 29, 2013

(51) Int. Cl.
*G08B 23/00* (2006.01)

(52) U.S. Cl.
USPC ..... 340/501; 340/626; 340/628

(58) Field of Classification Search
USPC ..... 340/501
See application file for complete search history.

(56) References Cited

U.S. PATENT DOCUMENTS 6,124,790 A * 9/2000 Golov et al. ..... 340/508
2010/0097207 A1* 4/2010 Mildenberger et al. .. 340/539.11

* cited by examiner

*Primary Examiner* — Tai T Nguyen
*Assistant Examiner* — Ojiako Nwugo
(74) *Attorney, Agent, or Firm* — Bay State IP, LLC

(57) ABSTRACT

An alarm system for a smoke or fire barrier, including alarm circuits have a normally closed switch position. A control circuit connected to the alarm circuits applies a voltage to create a non-activation situation or remove a voltage to create an activation situation when the switch is open. The alarm circuit further including either a series connected resistance or a normally open switch position in parallel to the normally closed switch position, to create a "fault" condition in the absence of detection of the resistance, or an open switch position and a closed switch position.

2 Claims, 3 Drawing Sheets

SMOKE OR FIRE BARRIER

BACKGROUND OF THE INVENTION

1. Field of the Invention

The present invention relates to an alarm circuit, particularly though not exclusively for use with a smoke or fire barrier 2. Description of the Related Art In this specification we use the following terms and meanings:

"curtain" means a textile screen that extends down from a deployment mechanism;

"barrier" means the apparatus including both the curtain and the deployment mechanism.

Our smoke or fire barriers generally comprise:

- a gravity fail safe curtain having an electric lift motor and an electromagnetic brake at the motor, the brake being for normally holding the curtain upon application of voltage to it and for fail safe release of it in absence of voltage;
- one or a plurality of alarm circuits, each having a normally closed, fire or smoke switch,
- a control circuit to which the or all of the alarm circuits is/are connected, the control circuit being adapted:
  - to apply voltage to the brake for holding curtain up and remove the voltage for release of the curtain, when the or one of the alarm circuits is open circuit.

We refer to such a barrier as a "barrier of the type defined".

A problem can arise in that one of the alarm circuits can remain closed even in the event of its fire or smoke detecting switch functioning correctly and opening. The problem is caused by some extraneous event such as a fixing penetrating the cable of the circuit and short-circuiting its pair of wires. This would not normally be detected, prior to an emergency, because of the normal state of the switch being closed.

SUMMARY OF THE INVENTION

The object of the invention is to overcome this albeit rare problem.

According to the invention there is provided an alarm system including:

- one or a plurality of alarm circuits, each having a normally closed, switch position;
- a control circuit to which the or all of the alarm circuits is/are connected, the control circuit being adapted:
  - to apply a voltage to create a non-activation situation when the switch is closed; and
  - remove the voltage to create an activation situation when the or one of the alarm circuits is open and
- means for detecting a fault in an alarm circuit, the control circuit being adapted to remove the voltage to create an activation situation when a fault is detected.

In some embodiments the means for detecting the fault may include:—

- the or each alarm circuit including a respective series connected resistance at its switch to present the resistance to the control circuit when the switch is closed and
- the control circuit is further adapted to:
  - detect the resistance of the or each alarm circuit and
    - apply the voltage to create a non-activation situation when the resistance is detected in the or all of the alarm circuits, indicating switch closure, and
    - apply no voltage not only when the or any one of the alarm circuits is open circuit but also when the resistance is not detected.

In other embodiments the means for detecting the fault includes:—

- the alarm circuit further including a normally open switch position, in parallel to the normally closed position, the switch operable in positions creating a normally closed circuit and a normally open circuit; and
- the control circuit adapted to:
  - detect the condition of the normally open circuit and the normally closed circuit, and
    - apply the voltage when the normally closed circuit is closed and the normally open circuit is open;
    - apply no voltage when the normally closed circuit is open and the normally open circuit is closed, in an alarm situation;
  - apply no voltage when both circuits are closed, indicating a "fault" situation.

BRIEF DESCRIPTION OF THE DRAWINGS

To help understanding of the invention, a specific embodiment thereof will now be described by way of example and with reference to the accompanying drawings, in which.

DETAILED DESCRIPTION OF THE PREFERRED EMBODIMENT

Figure 1:
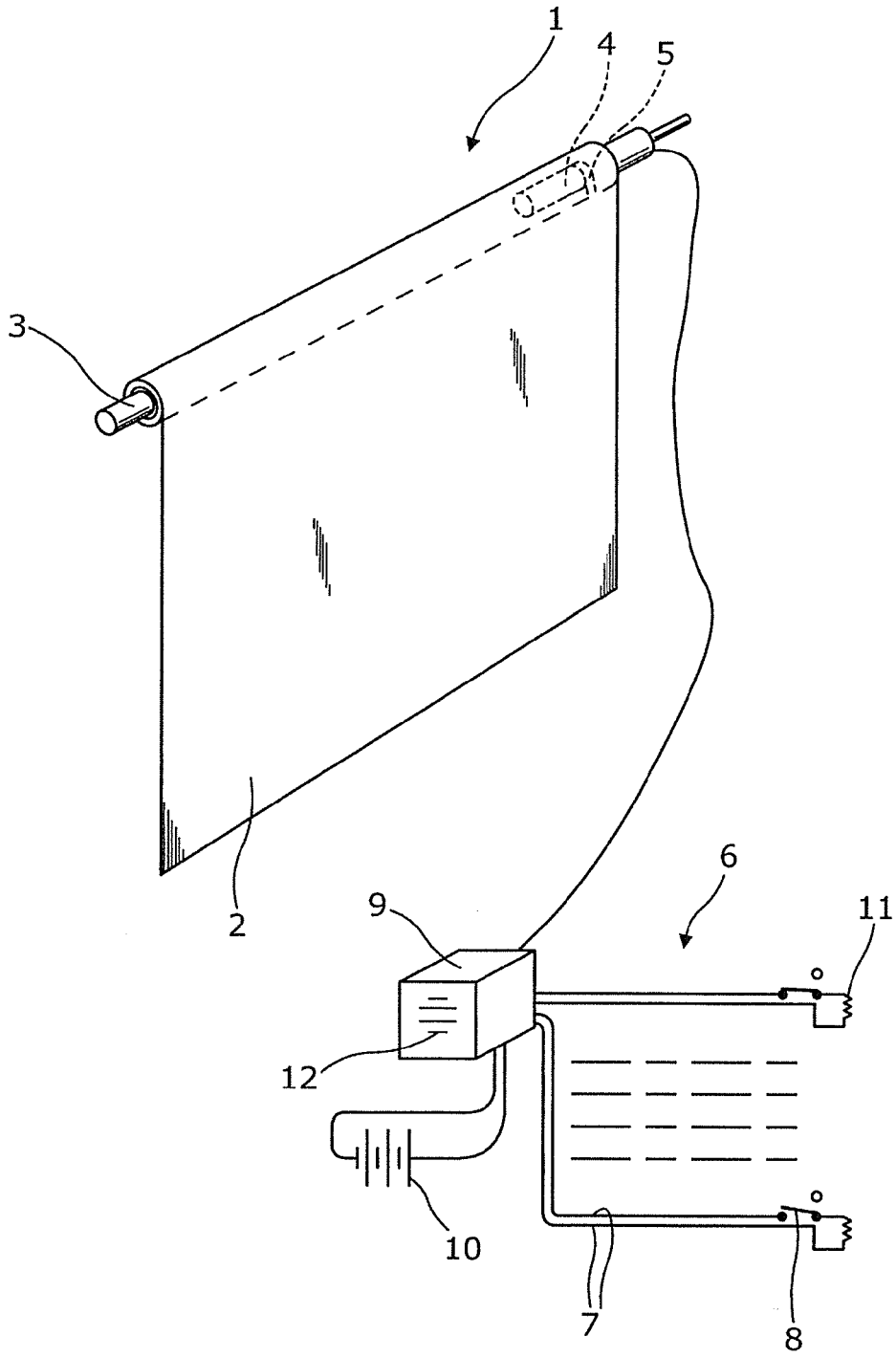
FIG. 1 is a diagrammatic view of a fire barrier according to the invention.

Referring to the FIG. 1, a fire barrier 1 has a gravity fail safe curtain 2 wound on a roller 3, in which is arranged an electric lift motor 4 with an associated, normally applied electromagnetic brake 5. A number of alarm circuits 6, comprising a pair of wires 7 and a normally closed switch 8 inter-connecting the wires remote from the curtain, lead back to a control circuit 9. From a battery 10, the control circuit normally applies voltage to the brake. This voltage is removed in the event of the circuit detecting that one of the switches has gone open circuit and the curtain is dropped under gravity.

The control circuit also includes connections for applying the voltage to the motor for winding up the curtain as required. As thus far described, the barrier 1 is conventional.

In accordance with the invention, a resistance 11, typically a thousand ohms, is in series with the switch at the distal end of the wires. The control circuit is adapted to distinguish not only between open circuit and closed circuit as conventionally but also to distinguish both of these from the third 1000Ω state. The details of the control circuit are believed to be within the capability of the skilled man and will not be described in full here.

The "normal" state is that 1000Ω is across every pair of wires 7, when tested by the controller. When this state is detected by the control circuit, the brake voltage is applied by the control circuit to the brake. The curtain is held from deploying.

The "fire detected" state is when open circuit is detected across any pair of wires 7, as a result of the respective switch changing state because of a fire. In this case, the brake is released and the curtain is lowered in a controlled fashion as conventionally.

The "fault" state is when the 1000Ω resistance has been short circuited in one of the alarm circuits, as by a fixing penetrating the wires. Another cause could be a cable fire short circuiting a pair of wires. Often alarm wires run in ducting for other cables and to this extent they can provide early warning of a fire as soon as it starts in power cables. However this is seen more as a fortuitous advantage than anything else. On detection of the fault state, the brake is released and the curtain is lowered as a precaution against the fault being caused by a real fire. At the same time a fault alarm 12, which can be an audio or a visual alarm, is set off. This can be at the work station of security staff in the building concerned. It can direct their attention to investigate a particular part of the building for a fire or other emergency or problem with the building.

Figure 2:
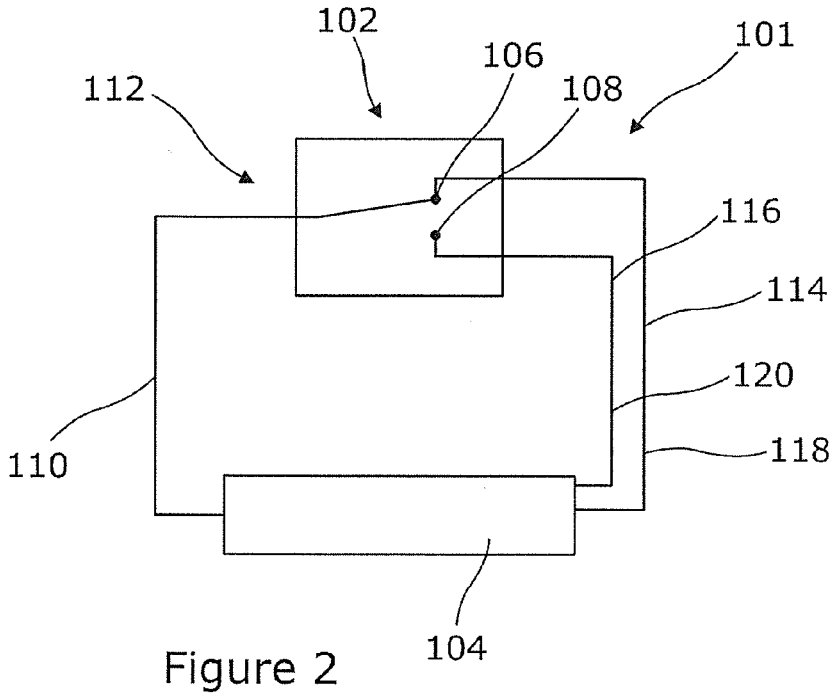
FIG. 2 is a diagrammatic view of an alarm circuit according to a second aspect of the invention.

Turning now to FIGS. 2-6, which show an alarm circuit according to a second embodiment of the invention. FIG. 2 shows an alarm circuit 101, which includes a relay switch 102 connected to a control circuit 104, which is connected to the fire barrier, for operating a normally applied electromagnetic brake as described with reference to the first embodiment. Typically many alarm circuits will be connected to the control circuit, for activation in response to a fire in various positions in a building.

The relay switch 102 has two contacts: a first normally closed contact 106, and a second normally open contact 108. The control circuit 104 is connected to the relay switch 102 by three wires, a first wire 110 connected to the first side 112 of the relay and second and third wires 114, 116 connected to the first 106 and second 108 contacts.

Thus the control circuit 104 can detect that the first circuit 118 including the first wire 110, the first contact 106, and the second wire 114 forms a normally closed circuit. It also can detect that the second circuit 120, including the first wire 110 and the second contact 108, and the third wire 116 forms a normally open circuit.

Figure 3:
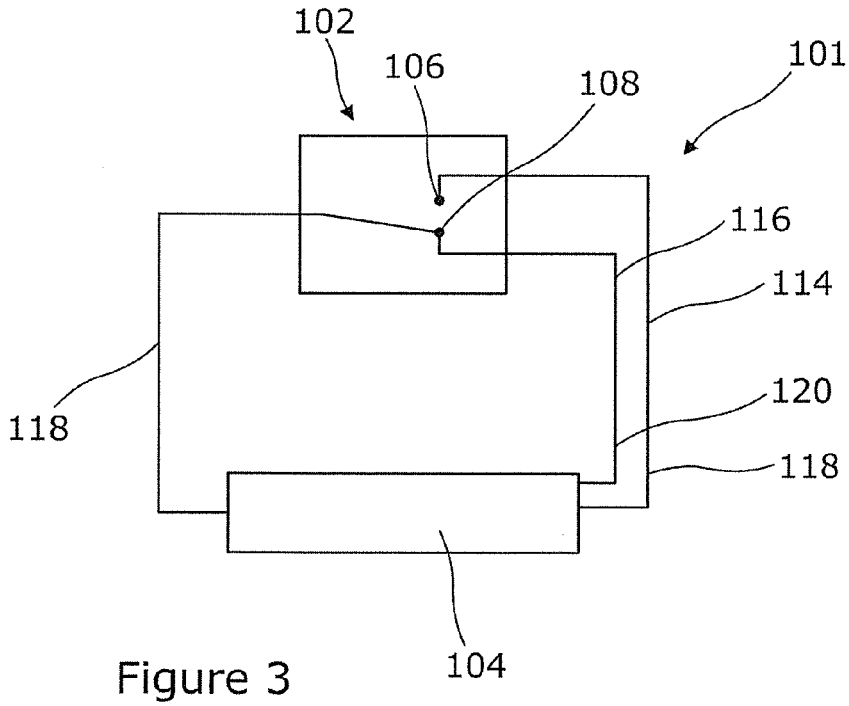
FIG. 3 is a diagrammatic view of the alarm circuit of FIG. 2 activated.

As shown in FIG. 3, as in the event of an alarm situation, the switch 102 moves to the second contact 108, closing the second circuit 120 and opening the first circuit 118. The control circuit then detects the first circuit 118 as open and the second circuit 120 as closed. In response the control circuit 104 issues an "alarm" condition, including removing the voltage from the normally applied brake, causing the fail safe curtain to deploy, as described with reference to the first embodiment.

Figure 4:
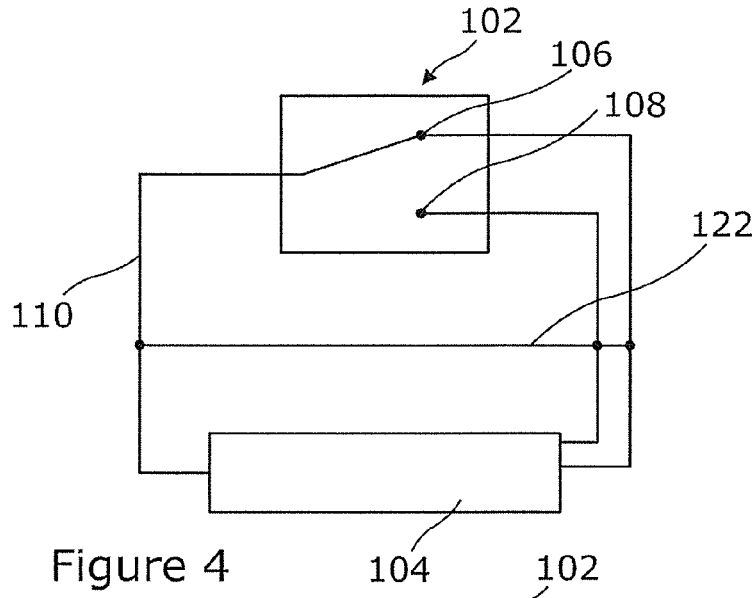
FIG. 4 is a diagrammatic view of the alarm circuit of FIG. 2 having a short circuit across all wires.

Now turning to FIG. 4, in the event of a short circuit 122 between all of the three wires in the alarm circuit, the control circuit, will detect the first circuit 118 as closed and the second circuit 120 as closed. In response to this the control circuit will issue a "fault" state, in which the curtain is deployed, and a "fault" alarm is issued, to alert security staff in the building to investigate. Such a "fault" could be as a result of a fixing penetrating the wires, or a fire.

Figure 5:
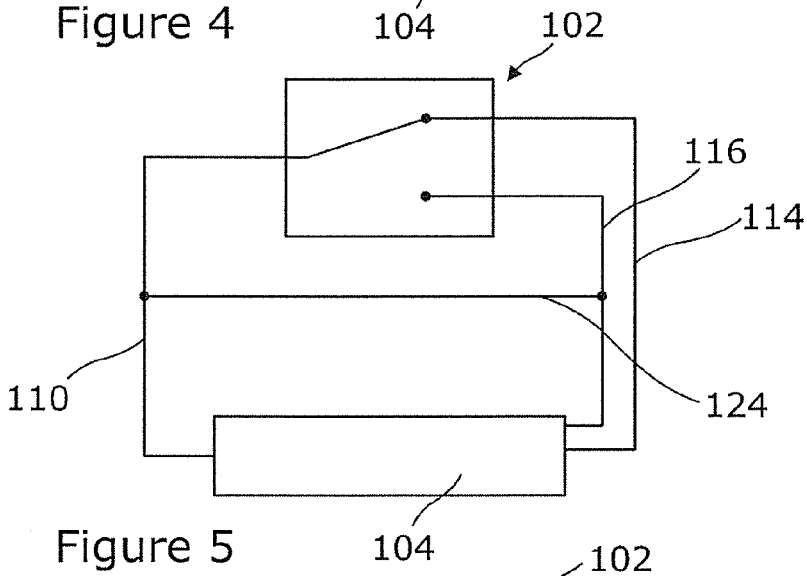
FIG. 5 is a diagrammatic view of the alarm circuit of FIG. 2 having a short circuit between one circuit.

In the event of a short circuit 124 between the first wire 110 and the third wire 116, in normal operation, absent an alarm signal, the control circuit will detect a closed first circuit 118 and a closed second circuit 120, as shown in FIG. 5. Again the control circuit will issue a "fault" alarm, deploying the curtain and alerting staff to investigate the fault.

Figure 6:
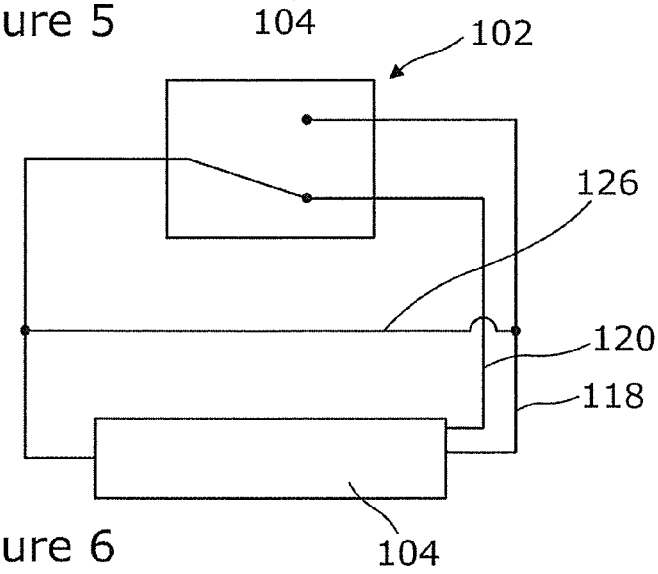
FIG. 6 is a diagrammatic view of the alarm circuit of FIG. 3 having a short circuit between the other circuit.

Finally, referring to FIG. 6, if there is a short circuit 126 between the first wire 110 and the second wire 114, in the event of am alarm signal, the control circuit will detect that both the first and second circuits 118, 120 are closed. Again the control circuit 102 will issue a "fault" alarm, deploying the curtain and alerting staff to investigate the fault. If the fault turns out to be a false alarm, for example by a penetration of the wires, the curtain can be wound back onto its roller and the alarm system reset. If however, the fault turns out to be an early warning of a fire, which is travelling in the ducting, for example, a full alarm state can be issued.

The invention is not intended to be restricted to the details of the above-described embodiment. For instance, the alarm system is described in relation to a fire alarm system for deploying a curtain. However, the alarm system could also be used in conjunction with any other system including an alarm, for example the automatic door closures, sounding beacons, fire shutters, ventilation systems.

The invention claimed is:

1. An alarm system including:

one or a plurality of alarm circuits, each having a normally closed, switch position;

a control circuit to which one or a plurality of the alarm circuits is/are connected, the control circuit being adapted:

to apply a voltage to create a non-activation situation when the switch is closed; and remove the voltage to create an activation situation when the or one of the alarm circuits is open and means for detecting a fault in an alarm circuit, the control circuit being adapted to remove the voltage to create an activation situation when a fault is detected, wherein the means for detecting the fault includes:

one or a plurality of alarm circuits including a respective series connected resistance at its switch to present the resistance to the control circuit when the switch is closed and the control circuit is further adapted to:

detect the resistance of one or a plurality of alarm circuits and apply the voltage to create a non-activation situation when the resistance is detected in the one or a plurality of the alarm circuits, indicating switch closure, and apply no voltage not only when one or a plurality of the alarm circuits is open circuit but also when the resistance is not detected.

2. An alarm system as claimed in claim 1, wherein the means for detecting the fault includes:

the alarm circuit further including a normally open switch position, in parallel to the normally closed position, the switch operable in positions creating a normally closed circuit and a normally open circuit; and the control circuit adapted to:

detect the condition of the normally open circuit and the normally closed circuit, and apply the voltage when the normally closed circuit is closed and the normally open circuit is open;

apply no voltage when the normally closed circuit is open and the normally open circuit is closed, in an alarm situation;

apply no voltage when both circuits are closed, indicating a "fault" situation.

* * * * *